US011092405B2

(12) United States Patent
Keng

(10) Patent No.: US 11,092,405 B2
(45) Date of Patent: Aug. 17, 2021

(54) FIREARM RECOIL PAD AND ASSOCIATED ACCESSORIES

(71) Applicant: Shane Keng, Marietta, GA (US)

(72) Inventor: Shane Keng, Marietta, GA (US)

( * ) Notice: Subject to any disclaimer, the term of this patent is extended or adjusted under 35 U.S.C. 154(b) by 0 days.

(21) Appl. No.: 16/448,682

(22) Filed: Jun. 21, 2019

(65) Prior Publication Data

US 2019/0390936 A1 Dec. 26, 2019

Related U.S. Application Data

(60) Provisional application No. 62/687,814, filed on Jun. 21, 2018.

(51) Int. Cl.
*F41C 23/22* (2006.01)
*B25B 27/02* (2006.01)
*F41C 23/08* (2006.01)

(52) U.S. Cl.
CPC ..... *F41C 23/22* (2013.01); *B25B 27/02* (2013.01); *F41C 23/08* (2013.01)

(58) Field of Classification Search
CPC ..... F41C 23/22; F41C 23/08; F41C 23/20
USPC ..... 42/108
See application file for complete search history.

(56) References Cited

U.S. PATENT DOCUMENTS 5,725,096 A * 3/1998 Winnard ..... A45C 13/02 206/350
6,082,227 A * 7/2000 Vogel ..... B25B 13/56 81/119
6,543,172 B1 * 4/2003 Armstrong ..... F41C 23/08 42/71.01
2005/0044967 A1 * 3/2005 Tsai ..... B25B 23/142 73/862.07
2011/0283582 A1 * 11/2011 Hunter ..... F41A 19/10 42/69.02
2013/0025071 A1 * 1/2013 Keng ..... B25F 1/003 7/118
2013/0174461 A1 * 7/2013 Ballard ..... F41C 23/08 42/74
2015/0266168 A1 * 9/2015 Geissele ..... B25B 13/48 29/525.11

OTHER PUBLICATIONS

Real Avid Gun Tool Pro AR 15; Real Avid; https://www.youtube.com/watch?v=MwfjsO19E68; Mar. 4, 2016 (Year: 2016).*

* cited by examiner

*Primary Examiner* — Joshua E Freeman
(74) *Attorney, Agent, or Firm* — Eversheds Sutherland (US) LLP

(57) ABSTRACT

A recoil pad assembly is provided and is configured to be removably attached to a firearm. The recoil pad assembly can include a recoil pad and a tool. The recoil pad can include a body having a first face, a second face, a first end, and a second end. A storage slot can be disposed into the first face of the body. The first face of the body can also include one or more anchors for removably attaching the assembly to the firearm. The tool can include one or more tools in or on its body and can be sized and shaped to be removably coupled to the recoil pad assembly by inserting the tool into the storage slot.

15 Claims, 12 Drawing Sheets

FIREARM RECOIL PAD AND ASSOCIATED ACCESSORIES

RELATED APPLICATIONS

This application claims priority under 35 U.S.C. § 119 to U.S. Provisional Patent Application No. 62/687,814 filed Jun. 21, 2018, and titled "FIREARM RECOIL PAD AND ASSOCIATED ACCESSORIES," the entire contents of which are hereby incorporated herein by reference for all purposes.

FIELD OF THE DISCLOSURE

The disclosure generally relates to firearm recoil pads and more particularly relates to a removable recoil pad with an embedded tool.

BACKGROUND

Firearm enthusiasts have enormous variety when selecting firearm accessories to equip a firearm. Rifles especially have an abundance of aftermarket accessories to interchange stock options that commonly come standard with the purchase of a rifle. For example, components such as the receiver, barrel, railing, and scope are all commonly upgraded to optimize the rifle for its intended use. Although many, if not all, of the components can be upgraded, at least three factors are considered before incorporating an aftermarket component. Weight, function, and space are all considered. If a component is light-weight, provides a superior function to the original equipment manufacturer (OEM) component, and the firearm has space for mounting the component, then the component is an ideal candidate for incorporating onto the firearm.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION OF EXAMPLE EMBODIMENTS

Figure 1:
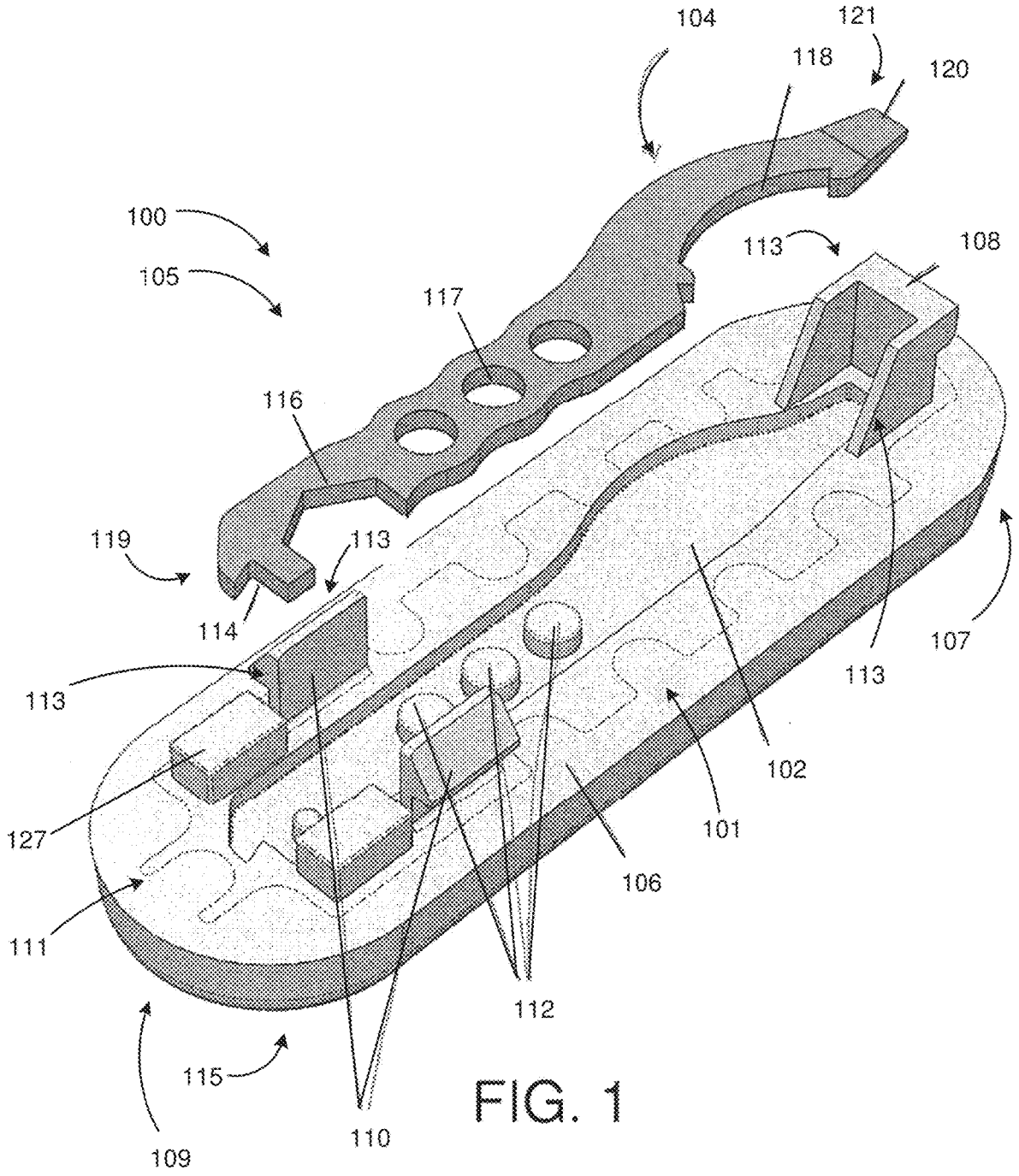
FIG. 1 depicts a perspective exploded view of a recoil pad assembly in accordance with one or more embodiments of the disclosure.

Example embodiments of the disclosure now will be described more fully hereinafter with reference to the accompanying drawings, in which exemplary embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like, but not necessarily the same or identical, elements throughout.

A recoil pad assembly is described herein. The recoil pad assembly can include a recoil pad that secures onto the butt of a firearm and a tool that secures within the recoil pad. The recoil pad can be coupled and decoupled from a firearm. The recoil pad can complement and attach to the butt of a firearm, thereby providing a softer surface for the user. The recoil pad can include a storage slot on a first face. The storage slot can receive and secure a tool therein. With or without the tool, the recoil pad can be attached or detached from the butt of a firearm. Beneficially, the recoil pad provides extra storage space for tools for use on the firearm.

In some examples, the storage slot can extend from a first end to a second end of the recoil pad. The storage slot can complement the shape of a buttstock of a firearm. In certain examples, the recoil pad may be compatible with an M-4 carbine buttstock, such as a B5 Sopmod. In some instances, the recoil pad may be coupled to another type of firearm buttstock. For example, the firearm buttstock may be, but is not limited to, an M-16 style rifle buttstock, an AR-15 style rifle buttstock, an AR-10 style rifle buttstock, or an M-4 style rifle buttstock, among others. The tool may be secured within the storage slot. In some examples, the storage slot may embed more than one tool. The tool can be coupled within the recoil pad or decoupled and removed from the recoil pad. In one example, the tool may be a one-piece tool. The tool may include one or more of a bolt override tool configured to aid in clearing malfunctions; a hex wrench for tightening scope rings; a dual-lug castle nut spanner wrench; and/or a slotted screwdriver for adjusting optics. The tool may include other embedded tools, such as a Philips head screwdriver, scissors, or some other tool. In some instances, the tool may include or couple to a castle nut spanner wrench with slotted screwdriver and/or a bolt override tool.

In certain example embodiments, the removable recoil pad includes a body with a first face, a second face, a first end, and a second end. The first face of the body includes a storage slot. The storage slot can extend from the first end to the second end. For example, the storage slot can be a recess into the first face of the body that defines a storage cavity in the first face so as to permit storage of the tool. In some instances, the storage slot may be the same or substantially the same shape as the tool. In other instances, the storage slot may be a different shape than the tool. For example, the storage slot can have a recess disposed adjacent to the storage slot. In some embodiments, the storage slot includes at least one nub extending from the storage slot. The at least one nub may receive the tool to secure the tool within the storage slot. That is, the tool may contain one or more apertures that secure onto the nub(s) within the storage slot.

In some embodiments, the recoil pad includes a set of anchors configured to secure the recoil pad onto the butt of a firearm. For example, the set of anchors may include an anchor at the first end of the body as well as a pair of anchor clips extending from the second end of the body. The anchor clips may be disposed on opposing sides of the storage slot. In some embodiments, an anchor may be attached to the first end of the body. The anchor may be configured to connect the removable recoil pad to the buttstock of a firearm. In some embodiments, two anchor clips may be disposed to the opposite end of the body from the anchor. The anchor clips may be configured to connect the recoil pad to the buttstock.

In some embodiments, the recoil pad assembly includes a tool with a distal end and a proximate end. The tool can complement the shape of the storage slot to be slidably secured therein. The tool described herein can refer to a multi-tool which has multiple functions. For example, the tool can include several tools along the body of the tool. In some examples, the tool includes a bolt override tool to aid in clearing malfunctions on a firearm. The bolt override tool may be rotatably engaged to the firearm. The bolt override tool may be any size, shape, or configuration. The bolt override tool may be used to create leverage on the bolt on the firearm when the bolt jams.

In some embodiments, the tool includes a hex wrench (e.g., a half-inch hex wrench) to tighten scope rings. The hex wrench may be rotatably engaged to the scope ring. In this manner, the tool may be rotated. In certain example embodiments, the hex wrench may be located on the same side of the tool as the bolt override tool. The hex wrench may be any configuration such that the hex wrench may tighten around a scope ring. In one embodiment, the side of the tool may be shaped such that only four of the six sides of a hexagon are embedded into the tool such that the tool engages four of the six sides of a hex-head bolt or screw. In another embodiment, a hexagonal shaped aperture is cut out of the center of the tool. In other instances, the hexagon may be fully embedded in the tool. The hex wrench may be more or less than a ½ inch hex wrench.

In some embodiments, the tool may include a dual-lug castle nut spanner wrench. The spanner wrench may be configured to engage any component of the firearm. In certain example embodiments, the spanner wrench may be located on the opposite side of the tool as the bolt override tool. The spanner wrench may be any size, shape, or configuration.

In some embodiments, the tool includes a slotted screwdriver. In certain example embodiments, the slotted screwdriver can be located on the distal end of the tool and can be used to adjust optics or other elements of the firearm. In other example embodiments, the slotted screwdriver may be disposed along any side of the tool. The slotted screwdriver may be rotatably engaged to any component of the firearm.

FIG. 1 depicts a perspective exploded view of a recoil pad assembly 100 in accordance with one or more example embodiments of the disclosure. Referring to FIG. 1, the recoil pad assembly 100 can include a recoil pad 101 and a tool 104. As shown, the tool is in an unsecured or decoupled position 105 from the recoil pad 101. In some examples, the tool 104 can be adjusted between a secured or coupled position (e.g., as shown in the secured position 203 in FIG. 2) and the unsecured or decoupled position 105 with respect to the recoil pad 101. The recoil pad 101 can include a body 106 with a first end 107, a second end 109, a first face 111, and a second face 115. In one example, the body 106 can include a storage slot 102 extending between the first end 107 to the second end 109 along the first face 111 and along a longitudinal axis of the recoil pad 101. In other example embodiments, the storage slot 102 may be embedded anywhere along the body 106. The tool 104 can engage and be secured within the storage slot 102 to couple the tool 104 to the recoil pad 101. In certain example embodiments, the second face 115 of the recoil pad 101 can be smooth. In other examples, the second face 115 can be textured (e.g., knurled, ridged, etc.).

Figure 12:
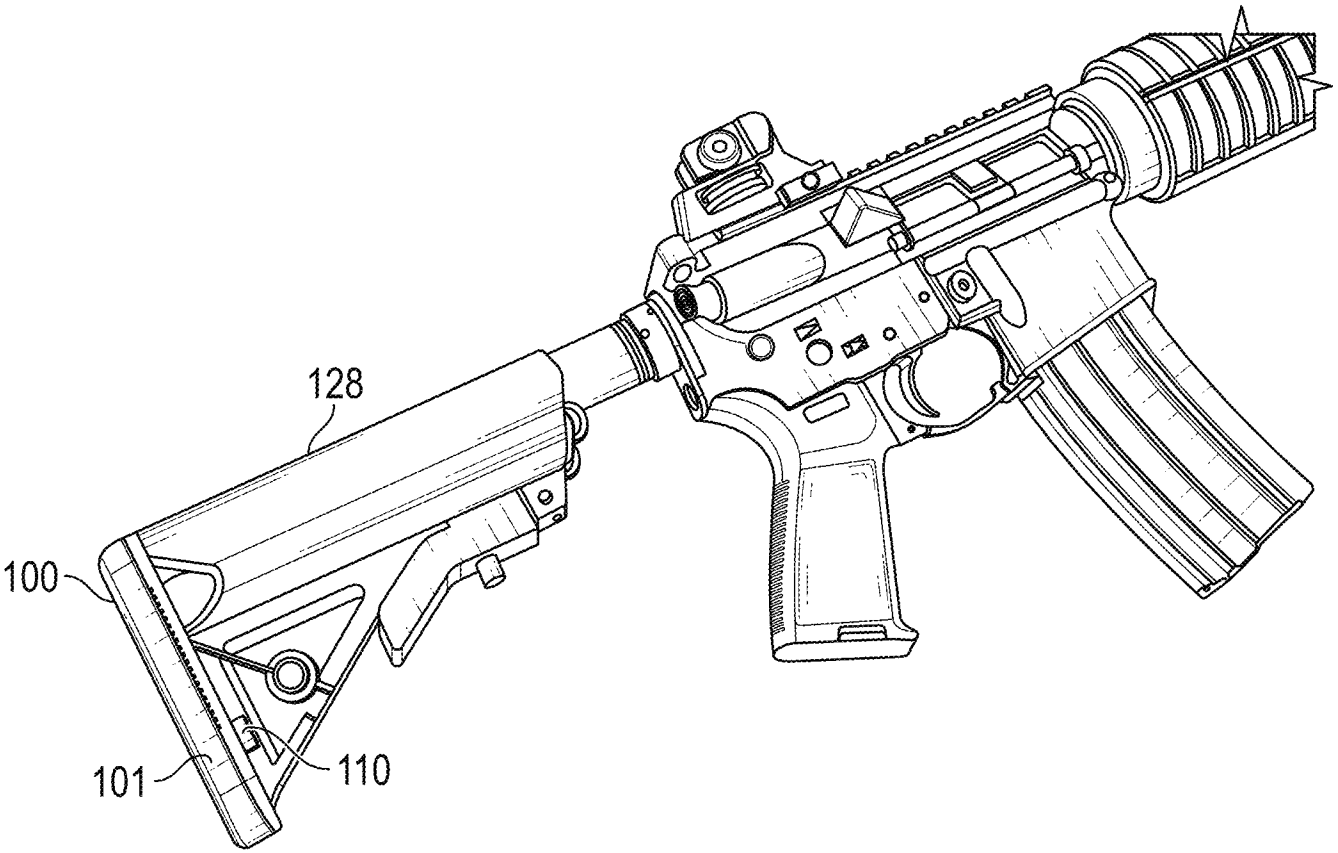
FIG. 12 depicts a perspective view of the recoil pad assembly attached to a firearm butt in accordance with one or more embodiments of the disclosure.

The recoil pad 101 can include a set of anchors 113. The set of anchors 113 can be disposed about the recoil pad 101 adjacent to the storage slot 102. The set of anchors 113 can include a first anchor 108 disposed the first face 111 on or adjacent to the first end 107 of the body 106. The first anchor 108 can extend out from the surface of the first face 111. The set of anchors 113 can include anchor clips 110. In one example, the anchor clips 110 are disposed on the first face 111 between the first end 107 and the second end 109 of the body 106 and positioned more closely to the second end 109 than the first end 107. As shown, the anchor clips 110 can be disposed adjacent to the storage slot 102 and can extend out from the surface of the first face 111. For example, a first anchor clip 110 can be disposed along a first lateral side of the storage slot 102, and a second anchor clip 110 can be disposed along a second lateral side of the storage slot 102. Each of the anchors in the set of anchors 113 is configured to latch onto a firearm butt (e.g., as shown in FIG. 12). That is, the firearm butt can include ledges within the butt to couple to each of the set of anchors 113. The body 106 can include at least one block 127. The block(s) 127 can extend out from the surface of the first face 111 and can help to guide the tool 104 into the storage slot 102. In one example, two blocks 127 are provided, one disposed along a first lateral side of storage slot 102 and a second disposed on a second lateral side of the storage slot 102.

The recoil pad 101 can also include one or more nubs 112 protruding from the storage slot 102. In one example, three nubs 112 are provided; however, fewer or greater than three nubs 112 can be provided. Each of the nubs can extend out from a floor surface of the storage slot 102. Each of the nubs 112 may be the same or different sizes and/or shapes and may be sized and shaped to be received into one of the corresponding tool apertures 117 on the tool 104 to help couple the tool 104 to the recoil pad 101 (e.g., as shown in FIG. 2).

The tool 104 can include one or more tools thereon. For example, the tool 104 can include a bolt override tool 114 on the proximate end 119. The tool 104 can include a hex wrench 116. In one example, the hex wrench can be positioned adjacent to the bolt override tool 114 on the tool 104. In some examples, the hex wrench 116 can contain four of the six sides of a hexagon. In other instances, the hex wrench 116 may contain more or less than four sides of the hexagon. The tool 104 can also include one or more tool apertures 117. Each tool aperture 117 can extend through the body of the tool from a first side of the tool 104 to an opposing second side. The apertures 117 may have the same or different shapes and may be positioned near the center of the tool 104 along a longitudinal axis of the tool 104. In one example, each tool aperture 117 may have a generally circular shape. The generally circular tool apertures may have the same or different diameters and are configured to receive all or a portion of a corresponding nub 112 therein. The tool 104 can also include a spanner wrench 118. In one example, the spanner wrench 118 can be disposed on or adjacent to one end of the tool 104 (e.g., the distal end 121). The tool 104 can also include a screwdriver 120. In one example, the screwdriver 120 is a slotted screwdriver; however, the screwdriver 120 can also be a Phillips-head screwdriver, a torx-head screwdriver, a hex-head screwdriver, or a pozidriv-head screwdriver. In one example, the slotted screwdriver 120 can be disposed on the distal end 121 of the tool 104. In one example, the spanner wrench 118 may be positioned between the tool apertures 117 and the slotted screwdriver 120.

Figure 2:
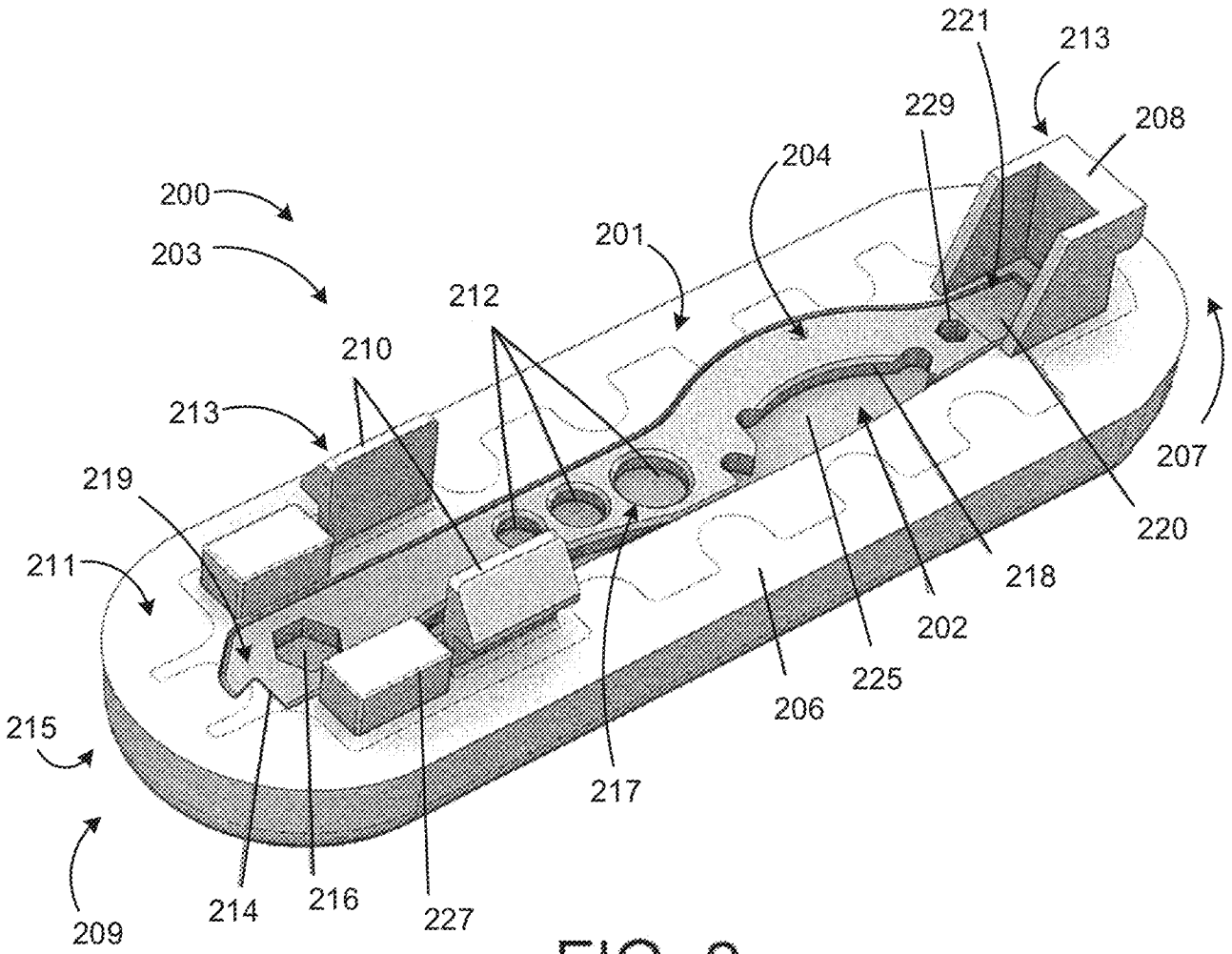
FIG. 2 depicts a perspective view of a recoil pad assembly in accordance with one or more embodiments of the disclosure.

FIG. 2 depicts a perspective view of a recoil pad assembly 200 in accordance with one or more embodiments of the disclosure. Referring now to FIG. 2, the recoil pad assembly 200 can include a recoil pad 201 and a tool 204. The recoil pad 201 can include a body 206 with a first face 211, a second face 215, a first end 207, and a second end 209. Along the first face 211, a storage slot 202 can extend along the body 206. The storage slot 202 can extend between the first end 207 to the second end 209 and along a longitudinal axis of the recoil pad 201. As shown, the tool 204 can be set into a secured position 203 within the storage slot 202. The tool 204 can be removed from the storage slot 202 via the recess 225 adjacent to the storage slot 202. A body 206 can include a set of anchors 213 extending from the first face 211 and configured to secure the recoil pad 201 onto a firearm buttstock (e.g., as shown in FIG. 12). The set of anchors 213 can include a primary anchor 208 and anchor clips 210, each of which latch onto a firearm buttstock. The anchor clips 210 may be disposed opposite of the primary anchor 208 on the body 206. Adjacent to the anchor clips 210, one or more blocks 227 are disposed on the body 206. The blocks 227 can extend out from the first face 211 of the recoil pad 201. The blocks 227 may help to guide the tool 204 into the storage slot 202 and/or help to secure the recoil pad 201 onto a firearm. In some instances, one or more nubs 212 protrude out from a bottom surface of the storage slot 202. The nubs 212 can have the same or different sizes and shapes and can each be sized and shaped to be slidably received within corresponding tool apertures 217 in the tool 204 to assist with securing the tool 204 to the recoil pad.

The tool 204 can include a bolt override tool 214. In one example, the bolt override tool is disposed along a first end of the tool 204. The tool 204 can also include a variety of other tools thereon, such as a first hex wrench 216 and a second hex wrench 229. In some instances, each hex wrench 216 may be disposed through the body of the tool 204 and may have six sides of the hexagon disposed in the middle of the tool 204. In other instances, the hex wrench 216 may be disposed elsewhere on the tool 204. The tool 201 can also include one or more tool apertures 217. Each tool aperture 217 can extend through the body of the tool from a first side of the tool 204 to an opposing second side. The apertures 217 may have the same or different shapes and may be positioned near the center of the tool 204 along a longitudinal axis of the tool 204. In one example, each tool aperture 217 may have a generally circular shape. The generally circular tool apertures may have the same or different diameters and are configured to receive all or a portion of a corresponding nub 212 therein. A spanner wrench 218 can be disposed near the distal end 221 of the tool 204 between the tool apertures 217 and the screwdriver 220. In some examples, the spanner wrench can include a series of indents along the inner crescent of the wrench to grapple items. In other examples, the spanner wrench can include a series of detents (e.g., as shown in FIG. 1) along the inner crescent of the wrench to grapple items. The tool 204 can also include a screwdriver 220. In one example, the screwdriver 220 is a slotted screwdriver; however, the screwdriver 220 can also be a Phillips-head screwdriver, a torx-head screwdriver, a hex-head screwdriver, or a pozidriv-head screwdriver. In certain example embodiments, the slotted screwdriver 220 can extend from the distal end 221 of the tool 204.

Figure 3:
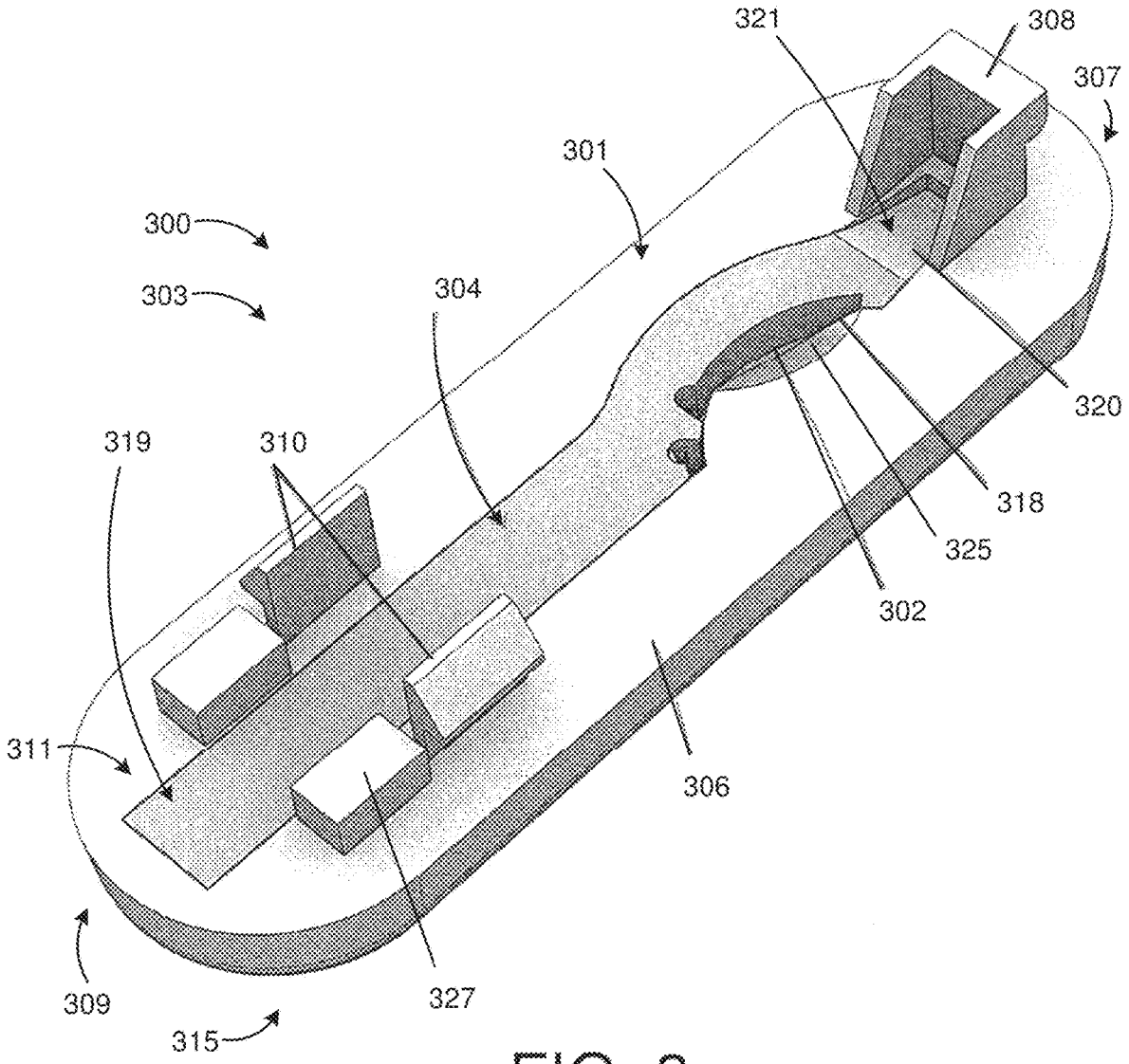
FIG. 3 depicts a perspective view of a recoil pad assembly in accordance with one or more embodiments of the disclosure.

FIG. 3 depicts a perspective view of a recoil pad assembly 300 in accordance with one or more embodiments of the disclosure. Referring now to FIG. 3, the recoil pad assembly 300 can include a recoil pad 301 and a tool 304. The recoil pad 301 can include a body 306 with a first face 311, a second face 315, a first end 307, and a second end 309. Along the first face 311, a storage slot 302 can extend along the body 306. The storage slot 302 can extend between the first end 307 to the second end 309 and along a longitudinal axis of the recoil pad 301. As shown, the tool 304 can be set into a secured position 303 and coupled to the recoil pad 301 within the storage slot 302. The tool 304 can be removed from the storage slot 302 via the recess 325 adjacent to the storage slot 302. In some examples, the depth of the recess may be shallower into the tool 304 than the depth of the storage slot 302. In other examples, the depth of the recess and the storage slot may be the same. In yet other examples, the depth of the recess may be deeper into the tool than the storage slot. The primary anchor 308 may be disposed on the body 306 and extend out from the first face 311. In one example, the primary anchor 308 is positioned adjacent to the first end 307 of the recoil pad 301. One or more anchor clips 310 can be disposed opposite of the primary anchor 308 on the body 306 and extend out from the first face 311. In one example, two anchor clips 310 are provided and positioned along opposing lateral edges of the storage slot 302. Adjacent to the anchor clips 310, one or more blocks 327 can be disposed on the body 306 and extend out from the first face 311. In one example, two blocks 327 are provided and positioned along the opposing lateral edges of the storage slot 302. The blocks 327 may help to guide the tool 304 into the storage slot 302 and/or help to secure the recoil pad 301 onto a firearm. In some instances, nubs 312 protrude from the storage slot 302 to receive the tool 304. The tool 304 can include a variety of tools thereon, such as a spanner wrench 318 disposed adjacent to the distal end 321 of the tool 304. A slotted screwdriver 320 can extend from the tool 304 at the distal end 321.

Figure 4:
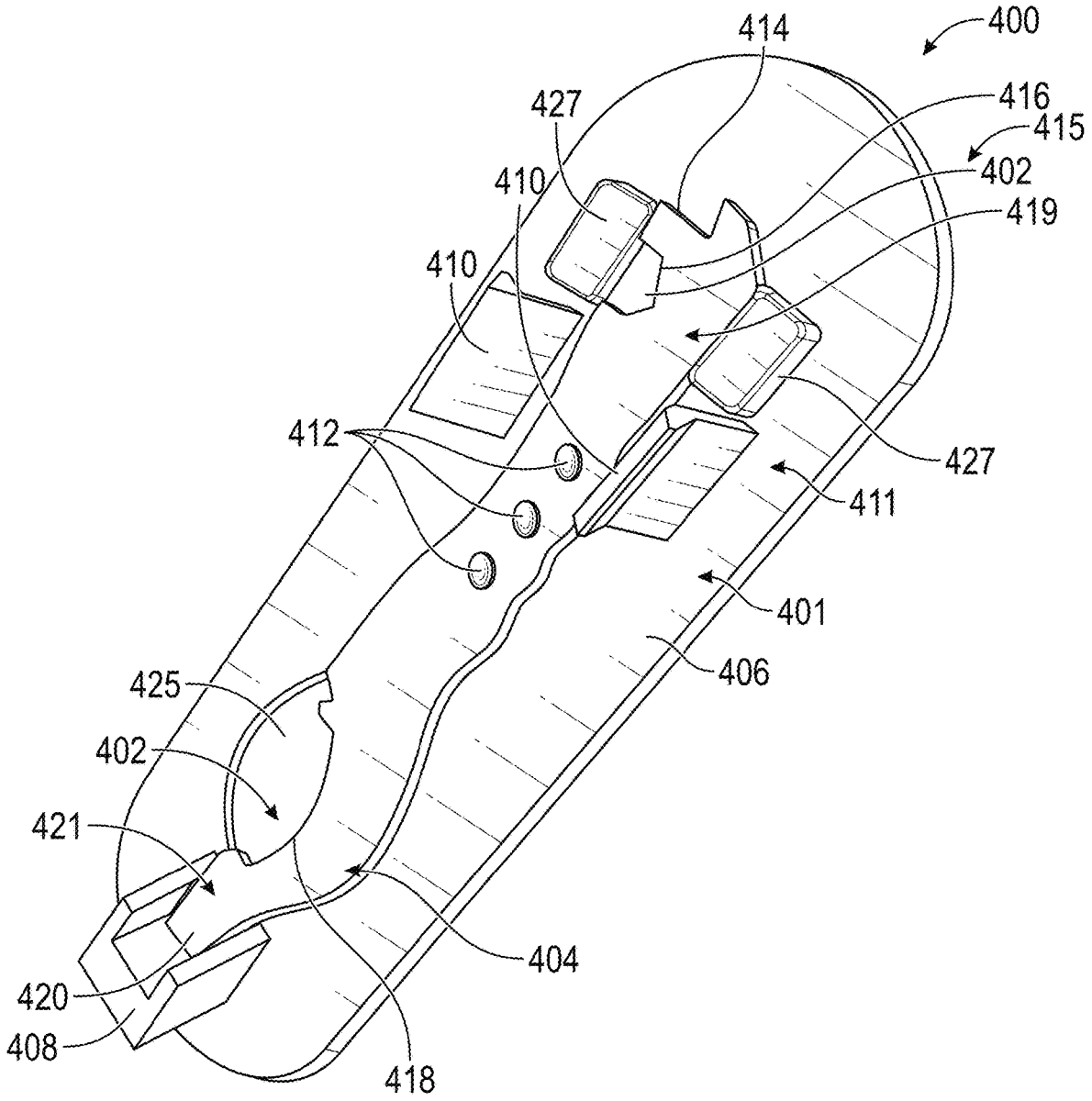
FIG. 4 depicts a perspective top view of the recoil pad assembly in accordance with one or more embodiments of the disclosure.

FIG. 4 depicts a perspective view of a recoil pad assembly 400 in accordance with one or more embodiments of the disclosure. Referring now to FIG. 4, the recoil pad assembly 400 can include a recoil pad 401 and a tool 404. The recoil pad 401 can include a body 406 with a first face 411, a second face 415, a first end, and a second end. Along the first face 411, a storage slot 402 can extend along the body 406. The storage slot 402 can extend between the first end 407 to the second end 409 along a longitudinal axis of the recoil pad. As shown, the tool 404 can be set into a secured position and coupled to the recoil pad 404 within the storage slot 402.

The tool 404 can be removed from the storage slot 402 via the recess 425 adjacent to the storage slot 402. The depth of the recess may be shallower into the tool 404 than the depth of the storage slot 402. In other examples, the depth of the recess and the storage slot may be the same. In yet other examples, the depth of the recess may be deeper into the tool than the storage slot.

The recoil pad 401 can include a set of anchors. The set of anchors can be disposed about the recoil pad 401 adjacent to the storage slot 402. The set of anchors can include a first anchor 408 disposed the first face 411 on or adjacent to the first end of the body 406. The first anchor 408 can extend out from the surface of the first face 411. The set of anchors can include one or more anchor clips 410. In one example, the anchor clips 410 are disposed on the first face 411 between the first end and the second end of the body 406 and positioned more closely to the second end than the first end. As shown, the anchor clips 410 can be disposed adjacent to the storage slot 402 and can extend out from the surface of the first face 411. For example, a first anchor clip 410 can be disposed along a first lateral side of the storage slot 402, and a second anchor clip 410 can be disposed along a second lateral side of the storage slot 402. Each of the anchors in the set of anchors is configured to latch onto a firearm butt (e.g., as shown in FIG. 12). That is, the firearm butt can include ledges within the butt to couple to each of the set of anchors. The body 406 can include at least one block 427. The block(s) 427 can extend out from the surface of the first face 411 and can help to guide the tool 404 into the storage slot 402. In one example, two blocks 427 are provided, one disposed along a first lateral side of storage slot 402 and a second disposed on a second lateral side of the storage slot 402.

The recoil pad 401 can also include one or more nubs 412 that protrude out from the storage slot 402. In certain examples, each nub 412 can extend out from a bottom surface of the storage slot 402. In one example, three nubs 412 are provided; however, fewer or greater than three nubs 412 can be provided. Each of the nubs 412 may be the same or different sizes and/or shapes and may be sized and shaped to be received into one of the corresponding tool apertures on the tool 404 to help couple the tool 404 to the recoil pad 401.

The tool 404 can include one or more tools thereon. For example, the tool 404 can include a bolt override tool 414. In one example, the bolt override tool 414 can be positioned along the proximate end 419 of the tool 404. The tool 404 can also include a variety of other tools thereon, such as a first hex wrench 416. In some instances, each hex wrench 416 may have six sides of the hexagon disposed in the middle of the tool 404. In other instances, the hex wrench 416 may be disposed elsewhere on the tool 404. The tool 404 can also include one or more tool apertures. Each tool aperture can extend through the body of the tool from a first side of the tool 404 to an opposing second side. The apertures may have the same or different shapes and may be positioned near the center of the tool 404 along a longitudinal axis of the tool 404. In one example, each tool aperture may have a generally circular shape. The generally circular tool apertures may have the same or different diameters and are configured to receive all or a portion of a corresponding nub 412 therein. The tool 404 can also include a spanner wrench 418. In one example, the spanner wrench 418 can be disposed on or adjacent to one end of the tool 404 (e.g., the distal end 421). The tool 104 can also include a screwdriver 420. In one example, the screwdriver 420 is a slotted screwdriver; however, the screwdriver 420 can also be a Phillips-head screwdriver, a torx-head screwdriver, a hex-head screwdriver, or a pozidriv-head screwdriver. In one example, the slotted screwdriver 420 can be disposed on the distal end 421 of the tool 404. In one example, the spanner wrench 418 may be positioned between the tool apertures and the slotted screwdriver 420.

Figure 5:
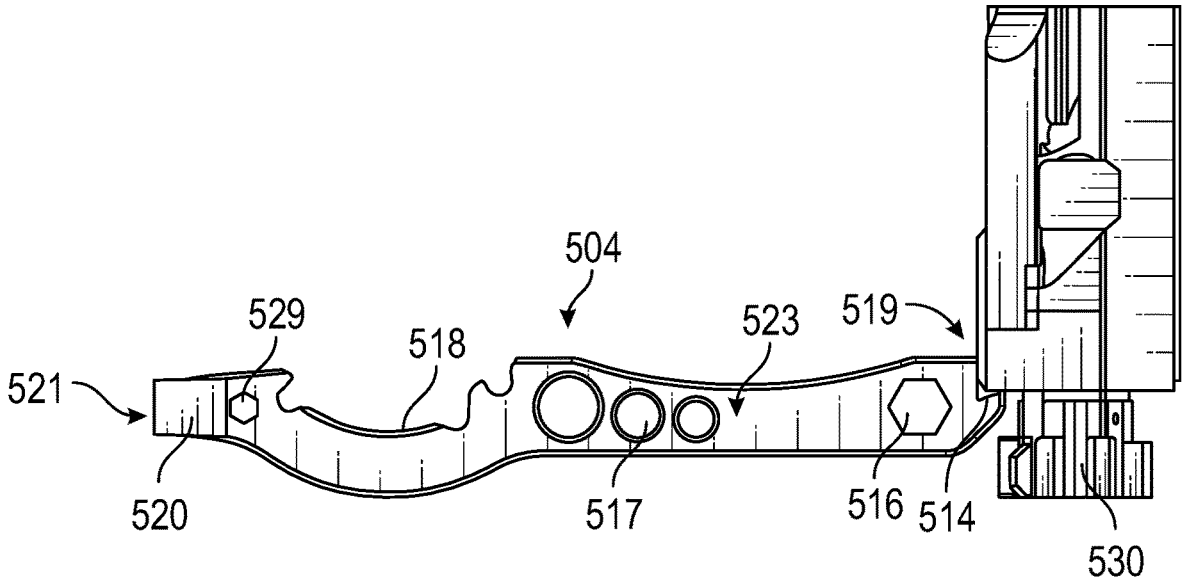
FIG. 5 depicts a front elevation view of a tool engaging a firearm in accordance with one or more embodiments of the disclosure.

FIG. 5 depicts the tool 504 engaged with a bolt of a firearm 530 in accordance with one or more embodiments of the disclosure. Now referring to FIG. 5, the tool 504 can include a tool frame 523 having a proximate end 519 and a distal end 521. Engaged with the firearm 530 is a bolt override tool 514 disposed on the proximate end 519 of the tool frame 523. Adjacent to the bolt override tool 514 is a hex wrench 516 disposed through the tool frame 523. A second hex wrench 529 can be disposed adjacent to a screwdriver head 520. Along the surface of the tool frame 523 is a set of apertures 517 disposed through the tool frame 523. As described above, each of the apertures can secure the tool frame 523 within the storage slot of the recoil pad. The distal end 521 end of the tool frame 523 includes a duel-lug castle nut spanner wrench 518 and a screwdriver head 520.

Figure 6:
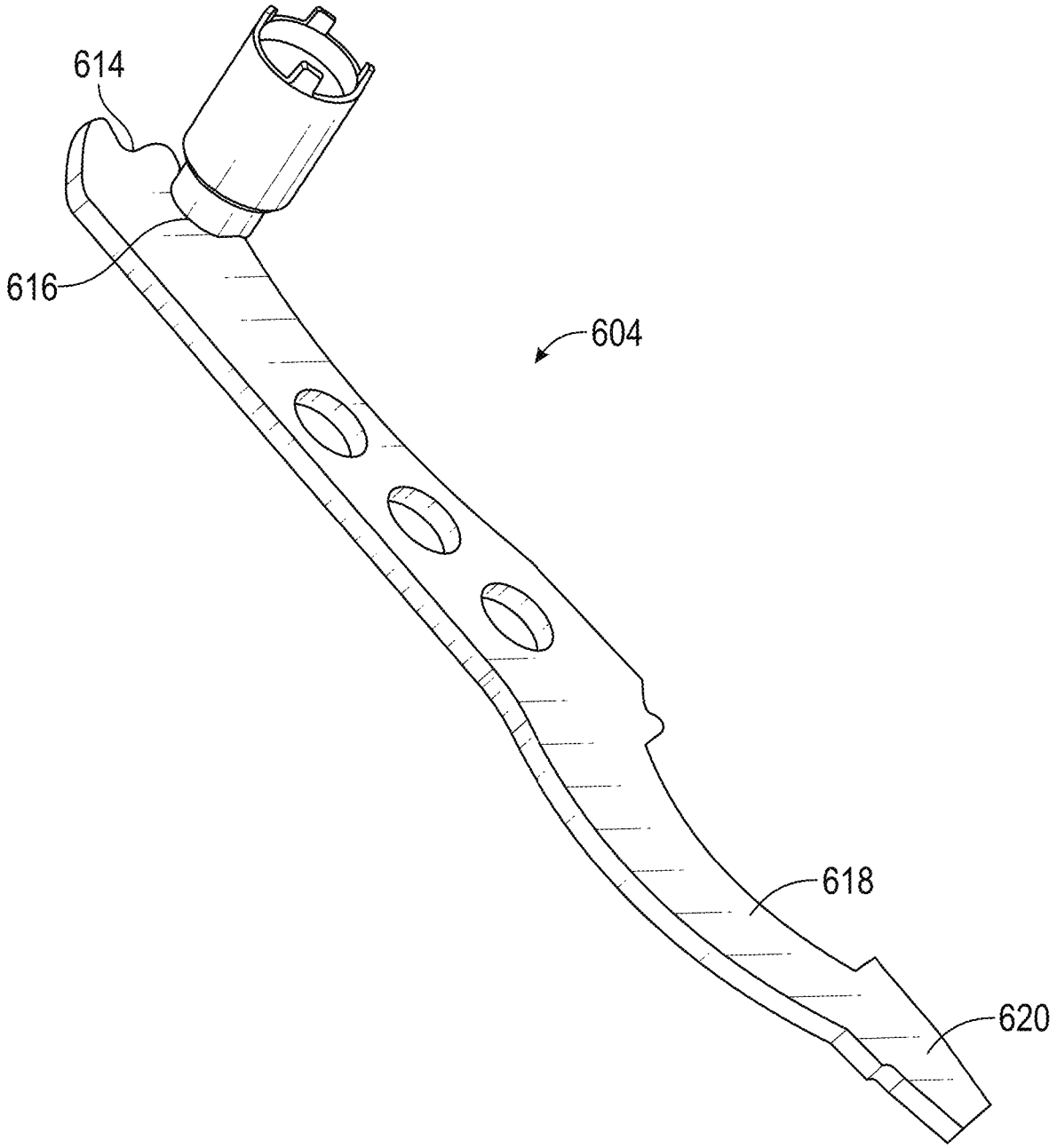
FIG. 6 depicts a perspective view of the tool coupled to a rotatable tool in accordance with one or more embodiments of the disclosure.

FIG. 6 depicts a perspective side view of the tool 604 coupled to a rotatable tool in accordance with one or more embodiments of the disclosure. Referring now to FIG. 6, the bolt override tool 614 may be coupled to one end of the tool 604. A hex wrench 616 may be disposed on one side of the body 606. In this embodiment, the hex wrench 616 contains only four of the six sides of the hexagon. A spanner wrench 618 is attached to the opposite end of the tool 604. A slotted screwdriver 620 is attached to the same end of the tool 604 as the spanner wrench 618.

Figure 7:
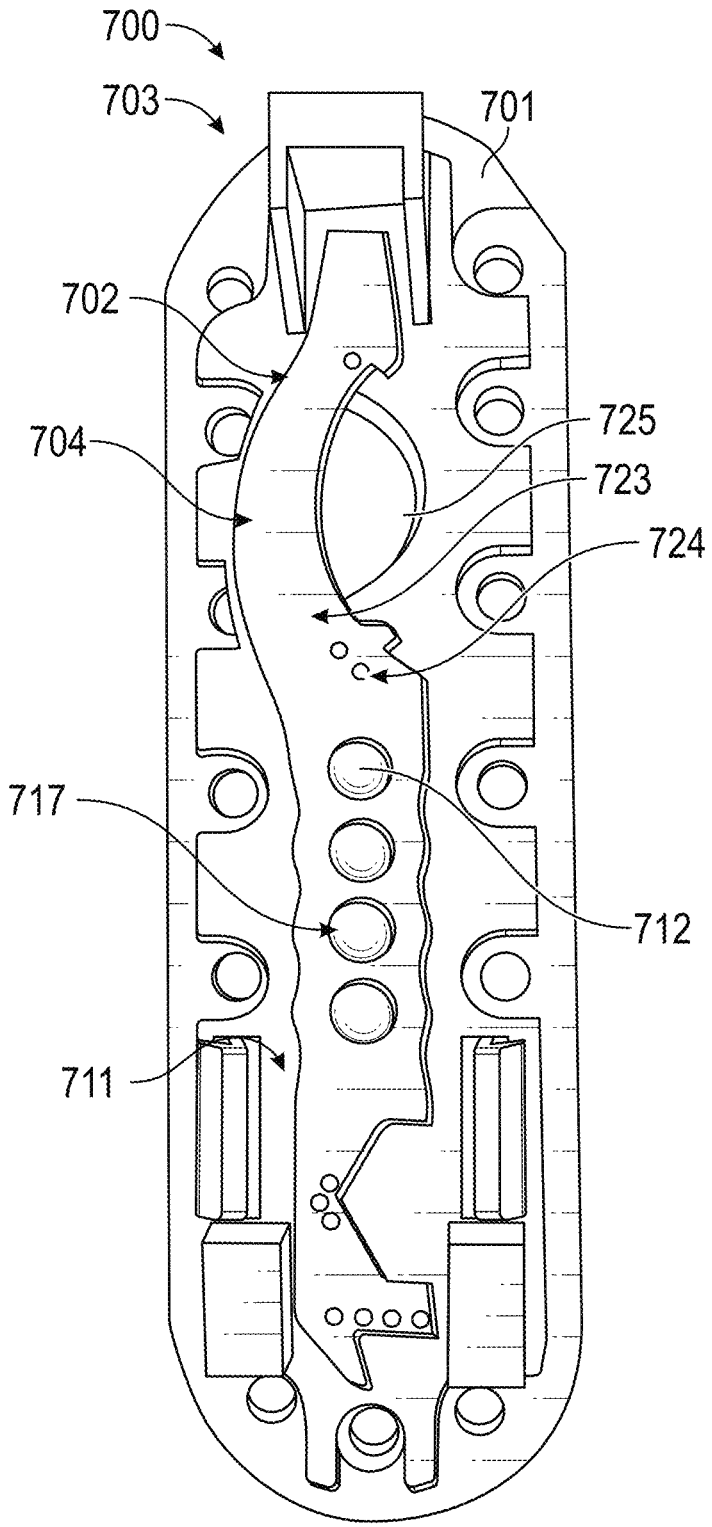
FIG. 7 depicts a front elevation view of the recoil pad assembly with the tool in a secured position in accordance with one or more embodiments of the disclosure.

FIG. 7 depicts a front elevation view of the recoil pad assembly 700 in accordance with one or more embodiments of the disclosure. Now referring to FIG. 7, the surface of the tool frame 723 can include a series of dot indicators 724. The series of dot indicators 724 can be paint applied to the tool 104. In other examples, the series of dot indicators may be indentions into the tool. Each of the dot indicators 724 can identify one or more tools on the tool frame 723. For example, two dots disposed on the tool frame 723 can indicate the location of the spanner wrench (or castle nut spanner). In some examples, one dot can indicate the slotted screwdriver, three dots can indicate the hex wrench, and four dots can indicate the bolt override. As shown, the tool 704 can be in a secured position 703 within the recoil pad 701. That is, the recoil pad 701 can include one or more nubs 712 slid within apertures 717 of the tool frame 723. The tool 704 is secured within a storage slot 702 of the recoil pad 701. A recess 725 can be positioned adjacent to the storage slot 702. The recoil pad 701 can include a series of recoil pad apertures 726 extending from the first face 711 to the second face (not shown).

Figure 8:
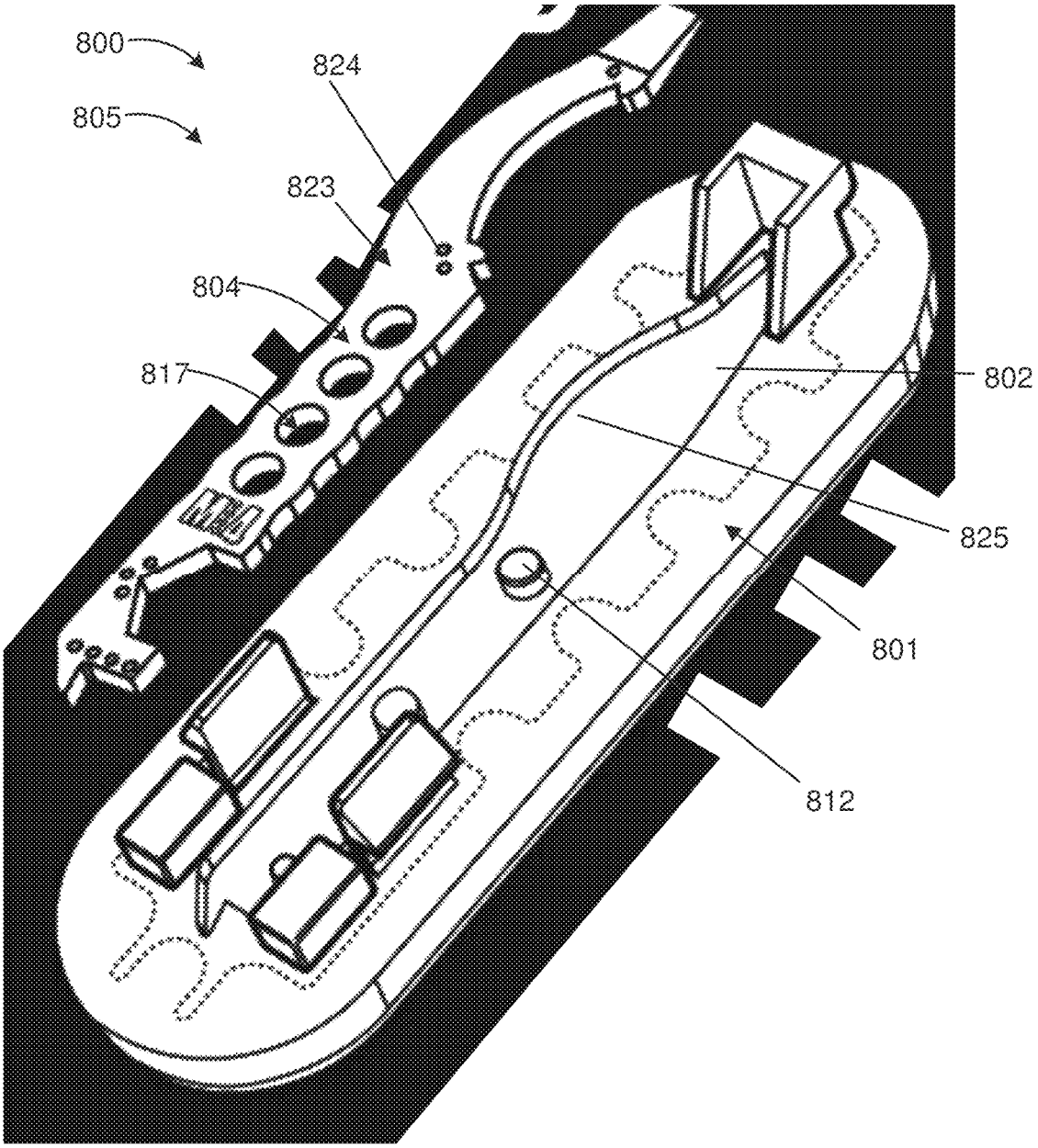
FIG. 8 depicts a perspective view of the recoil pad assembly with the tool in an unsecured position in accordance with one or more embodiments of the disclosure.

FIG. 8 depicts a front view of the recoil pad assembly 800 in accordance with one or more embodiments of the disclosure. Now referring to FIG. 8, the surface of the tool frame 823 includes a series of dot indicators 824. Each of the dot indicators 824 can identify one or more tools on the tool frame 823. For example, two dots disposed on the tool frame 823 can indicate the location of the spanner wrench (or castle nut spanner). In some examples, one dot can indicate the slotted screwdriver, three dots can indicate the hex wrench, and four dots can indicate the bolt override. As shown, the tool 804 can be in an unsecured position 805 within the recoil pad 801. That is, the recoil pad 801 can include one or more nubs 812 slid within apertures 817 of the tool frame 823. The tool 804 is secured within a storage slot 802 of the recoil pad 801, and adjacent to the storage slot 802 is a recess 825.

Figure 9:
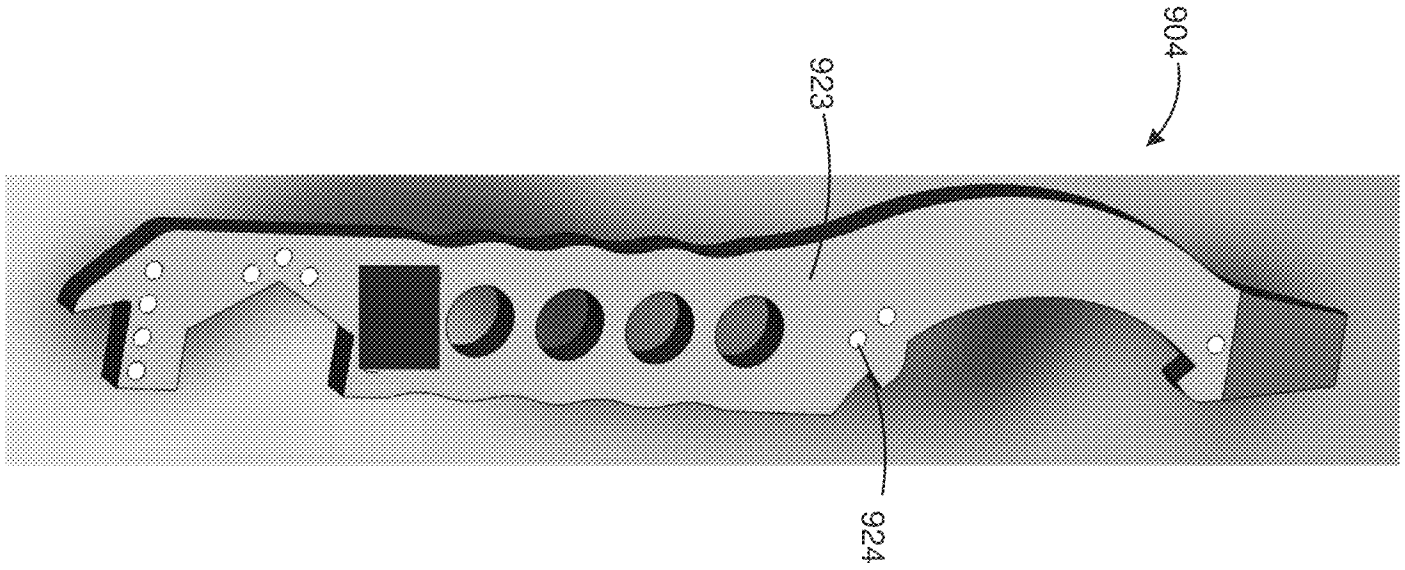
FIG. 9 depicts a perspective view of the tool of the recoil pad assembly in accordance with one or more embodiments of the disclosure.

FIG. 9 depicts a front view of the tool 904 in accordance with one or more embodiments of the disclosure. Now referring to FIG. 9, the surface of the tool frame 923 includes a series of dot indicators 924. Each of the dot indicators 924 can identify one or more tools on the tool frame 923. For example, two dots disposed on the tool frame 923 can indicate the location of the spanner wrench (or castle nut spanner). In some examples, one dot can indicate the slotted screwdriver, three dots can indicate the hex wrench, and four dots can indicate the bolt override.

Figure 10:
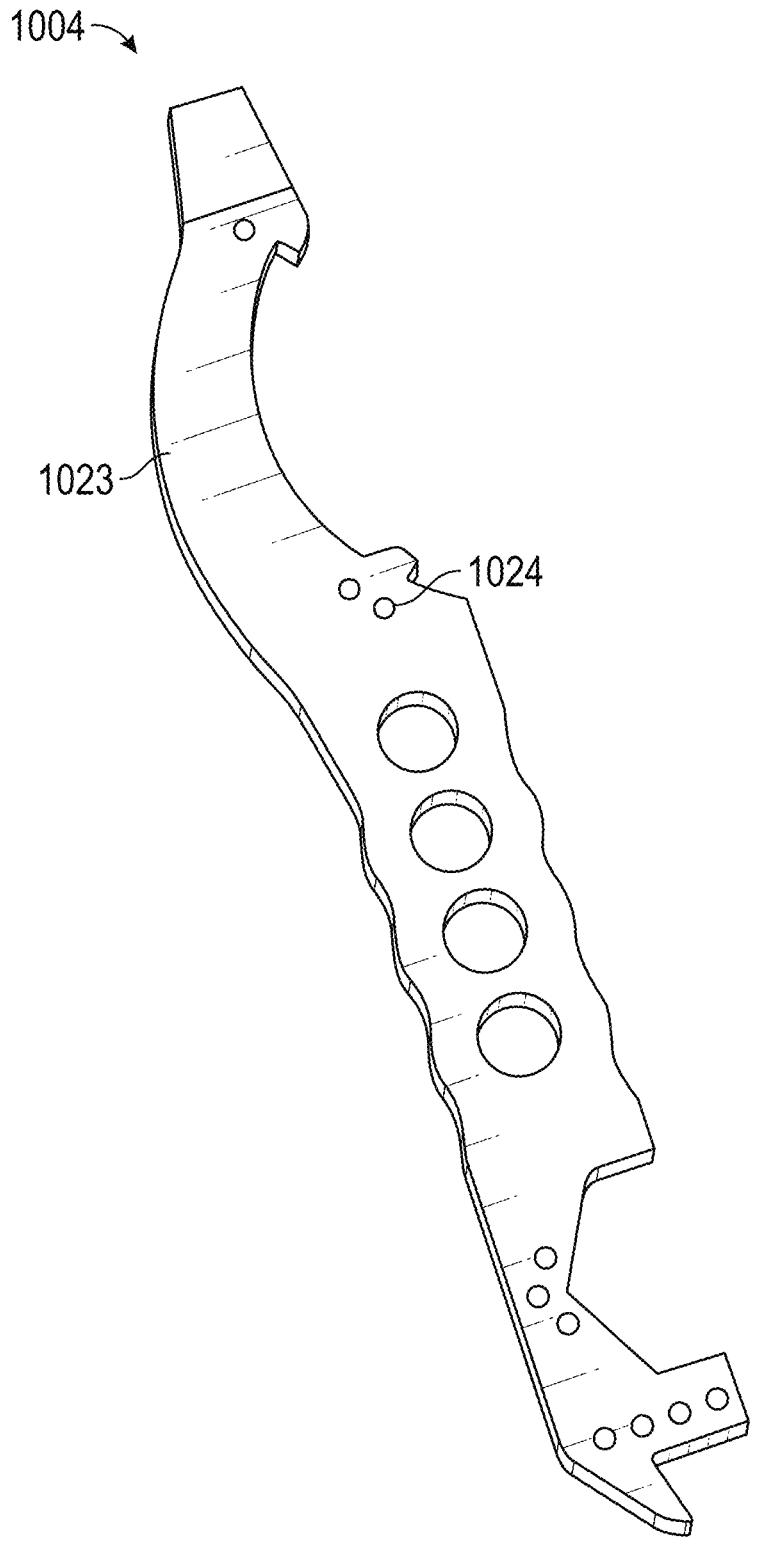
FIG. 10 depicts a perspective view of the tool of the recoil pad assembly in accordance with one or more embodiments of the disclosure.

FIG. 10 depicts a front view of a tool 1004 in accordance with one or more embodiments of the disclosure. Now referring to FIG. 10, the surface of the tool frame 1023 include a series of dot indicators 1024. Each of the dot indicators 1024 can identify one or more tools on the tool frame 1023. For example, two dots disposed on the tool frame 1023 can indicate the location of the spanner wrench (or castle nut spanner). In some examples, one dot can indicate the slotted screwdriver, three dots can indicate the hex wrench, and four dots can indicate the bolt override.

Figure 11:
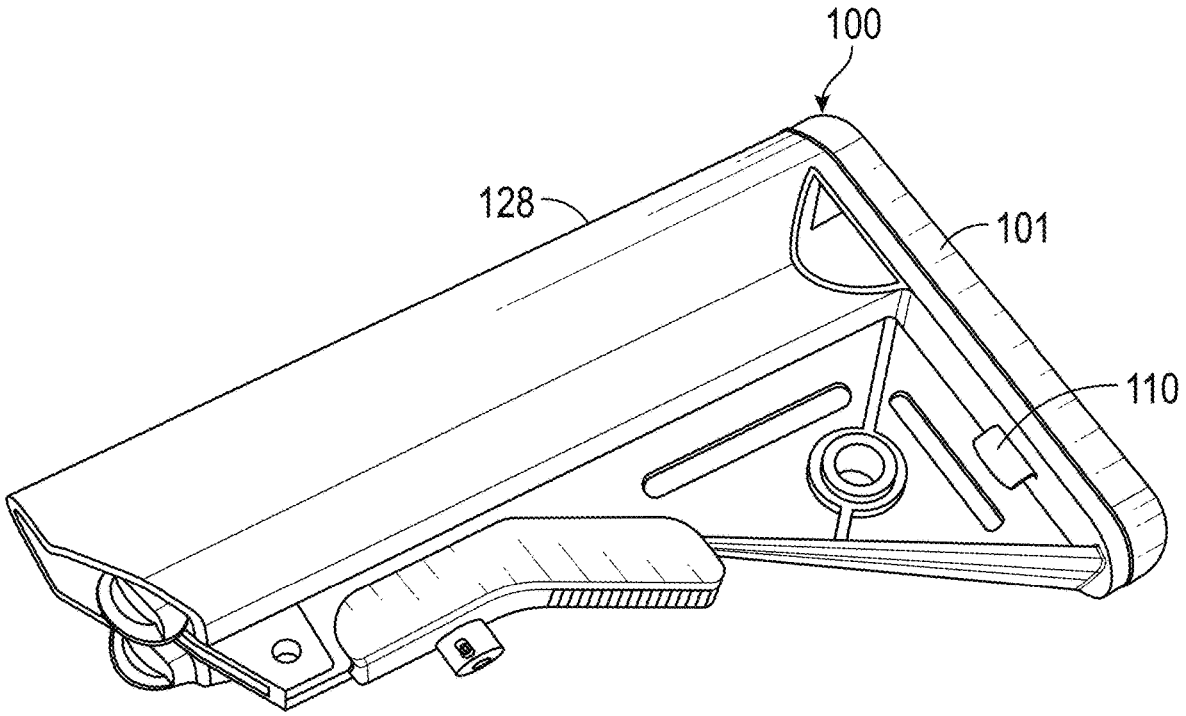
FIG. 11 depicts a perspective view of the recoil pad assembly attached to a firearm butt in accordance with one or more embodiments of the disclosure.

FIG. 11 depicts a perspective view of the recoil pad assembly 100 attached to a firearm buttstock 128 in accordance with one or more embodiments of the disclosure. The buttstock 128 may receive any one of the embodiments described herein. Now referring to FIG. 11, as shown, the anchor clip 110 is pushed through an aperture on the firearm buttstock 128 and latches into place. Each of the other anchors (not shown) similarly latch onto the firearm buttstock 128. The anchor clips 110 can be pushed towards one another to unlatch the recoil pad assembly 100 from the firearm buttstock 128. In some examples, a tool (for example, the tool 104 depicted in FIG. 1 is disposed within a storage slot (for example, the storage slot 102 depicted in FIG. 1) of the recoil pad 101. The recoil pad 101 is then latched onto the firearm buttstock 128 thereby storing the tool 104 between the buttstock 128 and the recoil pad 101.

FIG. 12 depicts a perspective view of the recoil pad assembly 100 attached to a firearm buttstock 128 in accordance with one or more embodiments of the disclosure. The firearm buttstock 128 may receive any one of the embodiments described herein. Now referring to FIG. 12, as shown, the anchor clip 110 is pushed through an aperture on the firearm buttstock 128 and latches into place. Each of the other anchors (not shown) similarly latch onto the firearm buttstock 128. The anchor clips 110 can be pushed towards one another to unlatch the recoil pad assembly 100 from the firearm buttstock 128. In some examples, the tool is disposed within the storage slot of the recoil pad 101. The recoil pad 101 is then latched onto the firearm buttstock 128 thereby storing the tool 104 between the buttstock 128 and the recoil pad 101.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A recoil pad assembly, comprising:

a recoil pad configured to be coupled to a buttstock of a firearm, the recoil pad comprising:

a body having a first face, a second face, a first end, and a second end;

a storage slot disposed into the first face of the body between the first end and the second end, wherein the storage slot extends along a longitudinal axis of the recoil pad;

at least one block extending from the first face and disposed adjacent to the storage slot;

at least one nub extending from a floor surface of the storage slot, wherein the at least one nub is configured to slidably receive at least one corresponding tool aperture of a tool; and a set of anchors disposed on the body adjacent to the storage slot and extending from the first face; and the tool removably coupled to the recoil pad, wherein the tool is configured to be inserted into the storage slot in a secured position, and wherein the at least one nub is configured to secure the tool to the recoil pad when the at least one nub is slidably received within the at least one corresponding tool aperture of the tool.

2. The recoil pad assembly of claim 1, wherein the tool comprises:

a tool frame with a proximate end and a distal end;

a spanner wrench in the tool frame; and a slotted screwdriver disposed at the distal end.

3. The recoil pad of claim 2, wherein the tool further comprises a hex wrench disposed in the tool frame.

4. The recoil pad assembly of claim 2, wherein the tool further comprises a bolt override tool disposed on the proximate end of the tool frame.

5. The recoil pad assembly of claim 2, wherein the tool further comprises a series of dot indicators disposed along the tool frame.

6. The recoil pad assembly of claim 1, wherein the set of anchors comprises:

a primary anchor extending from the first face of the body; and a pair of anchor clips extending out from the first face of the body and disposed adjacent to the storage slot.

7. A recoil pad assembly comprising:

a recoil pad configured to be coupled to a buttstock of a firearm, comprising:

a body having a first face, a second face, a first end, and a second end;

a storage slot disposed into the first face of the body, wherein the storage slot extends along a longitudinal axis of the recoil pad;

at least one block extending from the first face of the body and disposed adjacent to the storage slot;

a plurality of anchors disposed on the body adjacent to the storage slot and extending from the first face; and at least one nub extending from a floor surface of the storage slot, wherein the at least one nub is configured to slidably receive at least one corresponding tool aperture of a tool; and a tool configured to be removably coupled to the recoil pad, the tool comprising:

a tool frame having a proximate end and a distal end;

a bolt override tool disposed adjacent the proximate end of the tool frame;

a series of dot indicators disposed along the tool frame;

at least one aperture disposed on the tool frame and configured to receive at least a portion of the at least one nub, wherein the at least one nub is configured to secure the tool to the recoil pad when the at least one nub is slidably received within the at least one corresponding tool aperture of the tool;

a hex wrench disposed in the tool frame; and a dual-lug castle nut spanner wrench disposed in the tool frame, wherein the tool is configured to be inserted into the storage slot.

8. The recoil pad assembly of claim 7, wherein the plurality of anchors comprises:

a primary anchor disposed adjacent to the first end on the body; and a pair of anchor clips disposed on the body adjacent to the storage slot.

9. A recoil pad assembly comprising:

a recoil pad configured to be coupled to a buttstock of a firearm, comprising:

a body having a first face and a second face;

a storage slot disposed into the first face of the body, wherein the storage slot extends along a longitudinal axis of the recoil pad;

at least one block extending from the first face and disposed adjacent to the storage slot;

a plurality of anchors disposed on the body adjacent to the storage slot and extending from the first face; and a plurality of nubs extending from a floor surface of the storage slot, wherein the plurality of nubs is configured to slidably receive a plurality of apertures of a tool; and the tool configured to be slidably inserted into the storage slot, the tool comprising:

a tool frame having a proximate end and a distal end; and the plurality of apertures disposed on the tool frame, wherein each of the plurality of apertures is configured to receive one of the plurality of nubs to removably couple the tool to the recoil pad, and wherein the plurality of nubs is configured to secure the tool to the recoil pad when each of the plurality of nubs is slidably received within each of the plurality of apertures.

10. The recoil pad assembly of claim 9, wherein the plurality of anchors further comprises:

a primary anchor disposed on the body adjacent to a first end of the body; and at least one anchor clip disposed on the body adjacent to the storage slot.

11. The recoil pad assembly of claim 9, wherein the tool further comprises a spanner wrench disposed adjacent to the distal end of the tool frame.

12. The recoil pad assembly of claim 9, wherein the tool further comprises a slotted screwdriver disposed at the distal end of the tool frame.

13. The recoil pad of claim 9, wherein the tool further comprises:

a hex wrench disposed adjacent to the proximate end of the tool frame; and a dual-lug castle nut spanner wrench disposed adjacent to the distal end of the tool frame.

14. The recoil pad assembly of claim 9, wherein the tool further comprises a bolt override tool disposed on the proximate end of the tool frame.

15. The recoil pad assembly of claim 9, wherein the tool further comprises a plurality of dot indicators disposed along the tool frame, wherein each dot indicator identifies one of a plurality of tools on the tool.

* * * * *